United States Patent [19]

Musschoot

[11] Patent Number: 4,926,601

[45] Date of Patent: May 22, 1990

[54] VIBRATORY TUMBLING APPARATUS

[75] Inventor: Albert Musschoot, Barrington, Ill.

[73] Assignee: General Kinematics Corporation, Barrington, Ill.

[21] Appl. No.: 320,994

[22] Filed: Mar. 9, 1989

[51] Int. Cl.[5] ..... B24B 31/06

[52] U.S. Cl. ..... 51/7; 51/164.1; 241/183

[58] Field of Search ..... 51/6, 7, 17, 18, 313, 51/163.1, 164.1, 422, 423; 241/175, 183

[56] References Cited

U.S. PATENT DOCUMENTS

| | | | |
|---|---|---|---|
| 458,662 | 9/1891 | Pendleton | 241/175 X |
| 3,171,235 | 3/1965 | Spurlin et al. | 51/163.1 |
| 3,209,497 | 10/1965 | Powell | 51/163.1 |
| 3,580,520 | 5/1971 | Myers | 241/183 X |
| 3,942,644 | 3/1976 | Vissers | 51/164.1 X |
| 3,948,003 | 4/1976 | Pletscher | 51/164.1 |
| 4,003,164 | 1/1977 | Carpenter et al. | 241/183 X |
| 4,085,898 | 5/1978 | Jacubasch et al. | 241/175 |
| 4,177,955 | 12/1979 | Miller | 241/183 |
| 4,243,182 | 1/1981 | Dugger | 241/183 X |
| 4,709,507 | 12/1987 | Musschoot | 51/7 |

FOREIGN PATENT DOCUMENTS

| | | | |
|---|---|---|---|
| 46-28949 | 8/1971 | Japan | 241/175 |
| 0699335 | 11/1979 | U.S.S.R. | 241/175 |

*Primary Examiner*—Robert P. Olszewski

*Attorney, Agent, or Firm*—Wood, Phillips, Mason, Recktenwald & VanSanten

[57] ABSTRACT

A vibratory material handling apparatus is provided for mixing of materials, cleaning, blending and/or shake-out of castings or the like. The apparatus comprises a container having a curved or arcuate material supporting surface disposed about a generally horizontal longitudinal axis wherein the material supporting surface has a plurality of generally circumferential, parallel troughs disposed about and extending along the longitudinal axis. The container, which is carried by a frame, is resiliently mounted to a mounting surface. The apparatus further comprises a vibration generator mounted on the container for producing vibratory forces directed along a linear path displaced not only from the longitudinal axis but also from the center of gravity of the container. With this arrangement, the troughs are arranged to direct materials upwardly and forwardly to establish a path of tumbling movement in a direction from a material input end toward a material discharge end of the container.

19 Claims, 3 Drawing Sheets

FIG. Ia

VIBRATORY TUMBLING APPARATUS

FIELD OF THE INVENTION

The present invention generally relates to vibratory apparatus and, in particular, to a vibratory tumbling apparatus for diverse materials and applications.

BACKGROUND OF THE INVENTION

As is known in the art, there are many diverse applications wherein materials are to be mixed. Similarly, there are many manufacturing processes which require the cleaning or shake-out of parts such as castings, moldings or bulk material, with or without a working media. For both types of applications, it is useful to utilize a tumbling apparatus.

Some time ago, it was found that an improved finish could be obtained on cast or molded parts by adding a vibratory motion to the tumbling apparatus. For instance, in my earlier U.S. Pat. No. 3,157,004, an improved burnishing apparatus using a U-shaped tub mounted on trunnions was disclosed wherein vibratory force was applied directly to the U-shaped tub such that the force passed through the center of gravity of the tub. When the tub was tilted about the trunnions, the vibratory force was used to discharge the media and parts from the tub.

Although improved burnishing of the parts resulted from this use of vibratory motion through the center of gravity of the tumbling apparatus, problems continued with the balance of the machine. These included wear on bearings and the time it took to obtain the desired finish. To overcome such problems, a vibrating tumbling apparatus was conceived and developed as fully disclosed in my earlier U.S. Pat. No. 4,709,507.

According to that invention, a container is vibrated along small segments of an arcuate or circular path centered at a point offset from the center of the container. The material in the container is moved or conveyed and tumbled not only due to the coefficient of friction of the material with the surface of the container, but also due to the angle of attack between the material and the surface of the container at any given point because of the segmental circular path. While highly satisfactory tumbling action resulted from this improved arrangement, certain problems were discovered which required further attention.

In particular, my earlier U.S. Pat. No. 4,709,507 taught that the inner surface of the container may be coated or lined. More specifically, this coating or lining was taught as comprising a material having a particular coefficient of friction, which typically would comprise a material such as rubber or leather, which material was to aid in the conveying action and to improve the tumbling of the parts. In addition, the liner was recognized as comprising a wear surface which could be replaced when it had been worn.

Unfortunately, typical materials utilized because of their coefficient of friction usually have certain less than desirable physical characteristics. For instance, rubber or leather which is otherwise well suited for the intended purpose cannot withstand high temperatures and, thus, hot castings cannot immediately be treated in such a vibratory tumbling apparatus without the liner incurring substantial damage. Furthermore, depending upon the materials treated in the apparatus, the useful life of the liner is less than would normally be considered desirable.

In addition, in order to maximize the mixing, burnishing, etc., it is desirable for the material in the apparatus to experience the best possible tumbling action. Thus, when the vibratory tumbling apparatus utilizes a generally horizontally arranged cylindrical container, it is desirable for the material to be vibrated upwardly along the inside surface of the container to the maximum extent possible before the material falls back by gravity to a lower point in the container. However, while conveying action is enhanced by utilizing a carefully selected liner, e.g., rubber or leather, it would remain desirable to be able to convey the material to a higher point.

The present invention is specifically directed to overcoming the above stated problems and accomplishing the resulting objectives in a novel and simple manner.

SUMMARY OF THE INVENTION

Accordingly, the present invention is directed to a vibratory apparatus comprising a container having a curved or arcuate material supporting surface disposed about a generally horizontal longitudinal axis. The container has a center of gravity which is offset from the longitudinal axis and the curved material supporting surface has a plurality of generally circumferential, parallel troughs disposed along the longitudinal axis. Further, the vibratory apparatus includes means for resiliently mounting the container relative to a mounting surface together with vibration generating means mounted on the container.

With this arrangement, the vibration generating means produces vibratory forces directed along a linear path displaced not only from the longitudinal axis but also from the center of gravity of the container. The linear path of vibratory forces passes on the side of the center of gravity remote from the longitudinal axis of the container to cause each point on the curved material supporting surface to rotate along a path lying on a segment of a circle. Preferably, each of the segments of the circles has a center of rotation located at a position displaced from the longitudinal axis and on the side thereof remote from the center of gravity of the container.

By reason of the position of the center of rotation, the segments of the circles do not conform to the curved material supporting surface. Thus, material in the container is moved or conveyed and tumbled not only due to the coefficient of friction of the material with the surface of the container but also due to the angle of attack between the material and the surface of the container at any given point because of the segmental circular path. For this purpose, the center of rotation preferably lies on a line extending normal to the linear path of vibratory forces and passing through the center of gravity of the container.

In a preferred embodiment, the container has a material input end in axially spaced relation to a material discharge end. Each of the troughs then advantageously have a positive pitch in a direction toward the material discharge end. In this manner, material will gradually be moved through the container by the preferably generally circumferential, parallel troughs which are generally V-shaped.

Typically, the vibratory apparatus will have a batch of material (which may be castings with or without media) in the container. It will also be appreciated that the vibratory apparatus may be used to mix materials of different characteristics in a highly efficient manner. For these diverse purposes, the angle of attack between the material and the container be varied to vary the characteristic action.

By varying the angle of attack, and utilizing the troughs, it is possible to establish a path of tumbling movement. Within this path, it is possible to vary the rate or character of mixing, to vary the rate of cleaning, to vary the amount of tumbling, to vary the conveying and tumbling action between the material and the curved or arcuate material supporting surface of the container and the like. In addition, the positive pitch of the troughs is responsible for directing the material from one end to the other of the container.

Still additional objects, advantages and features of the present invention will become apparent from a consideration of the following specification taken in conjunction with the accompanying drawings.

BRIEF DESCRIPTION OF THE DRAWINGS

FIG. 1*a* is a cross-sectional view taken on the line 1*a*—1*a* of FIG. 1;

DETAILED DESCRIPTION OF THE PREFERRED EMBODIMENT

Figure 1:
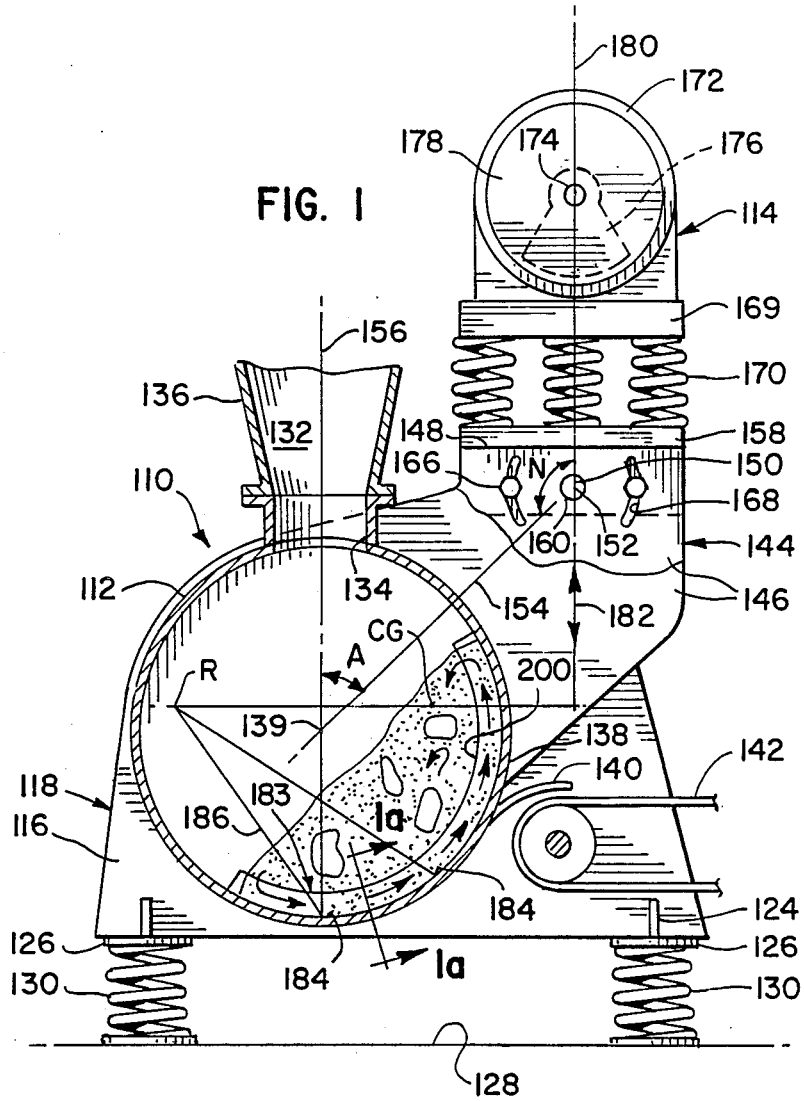
FIG. 1 is an end view of one preferred form of a vibratory tumbling apparatus with some parts shown in cross section and some parts shown in phantom.
Figure 1:
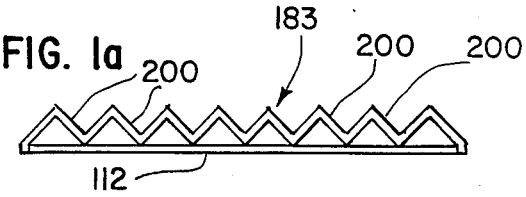
Figure 2:
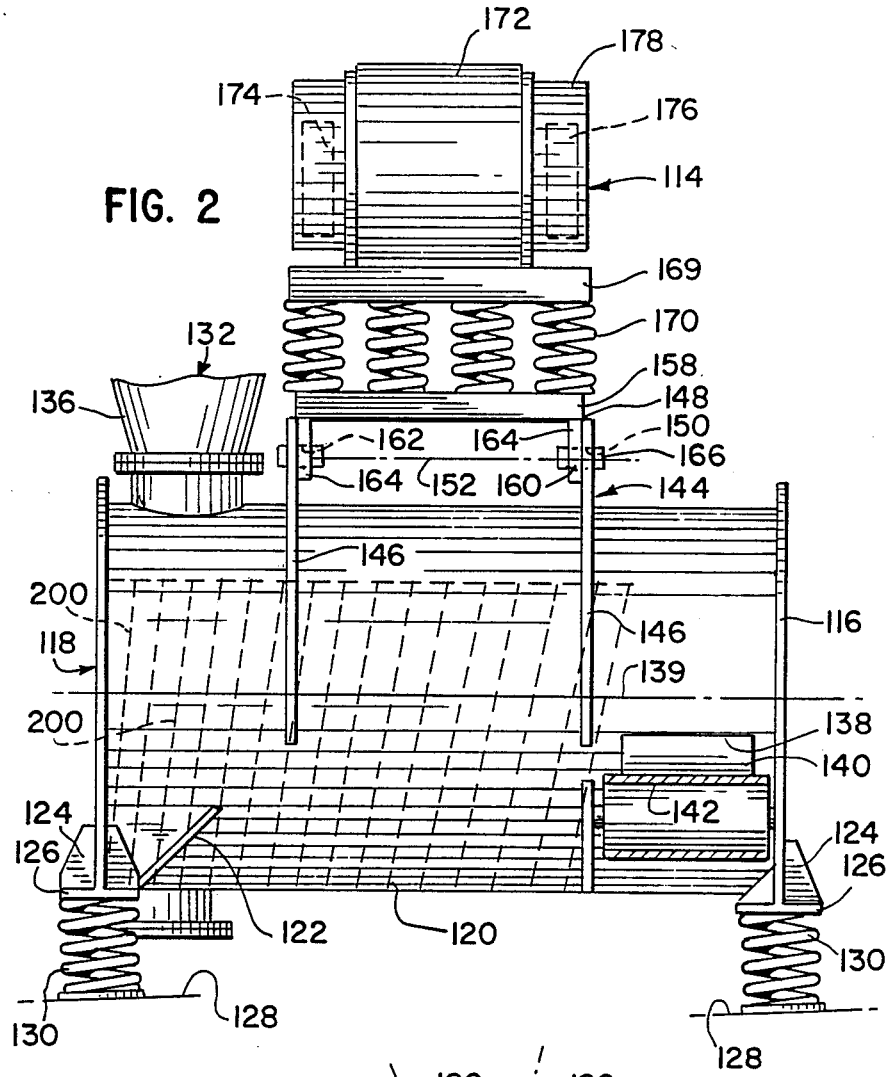
FIG. 2 is an elevational view of the apparatus of FIG. 1 as viewed from the right in FIG. 1.
Figure 3:
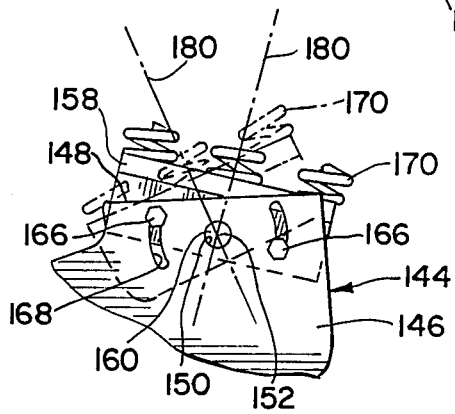
FIG. 3 is a detailed view of a portion of the apparatus of FIG. 1 illustrating differences in the line of application of the vibratory force.

Referring to the drawings, and first to FIGS. 1 through 3, a vibratory tumbling apparatus for mixing, cleaning and/or shake-out of parts is designated by the numeral 110 and comprises a container 112 which in the illustrated form is a cylindrical drum and a vibration generator 114. The container 112 could be an open top member, an oval member or any desired shaped member as long as it has a generally horizontal longitudinal axis. The container 112 is attached at each end to end plates 116 of a frame 118. In addition to the end plates 116, the frame 118 has a bottom 120 connected to the end plates with corner reinforcing gussets 122 extending between the container 112, and end plate 116 and the bottom plate 120 for supporting the container 112. Gussets 124 extend between a flange 126 and the end plates 116 in the vicinity of the corners of the apparatus to provide reinforced pads at the corners. The apparatus is resiliently supported on a mounting surface such as foundation or base 128 by means of springs 130 attached to the pads on the flanges 126 and to the foundation. The springs 130 may be coil springs, as shown, or may be air springs or the like.

The container 112 has an inlet port 132 near the high point of the container at one end portion, i.e., a material input end, and is comprised of a flanged opening 134 having a funnel shaped hopper 136. The inlet port 132 could be through the high part of the end plate 116 as an alternative to the arrangement illustrated. An outlet port 138 is formed through the side wall of the container 112 upward of the low point of the container and at the opposite end, i.e., the material discharge end, of the container from the inlet port 132. The outlet port 138 can be opened or closed, but when opened, has a platform 140 over which the discharged parts and/or media flows. A conveyor 142 communicates with the outlet port 138 for conveying discharged parts and/or media away from the apparatus. The discharge or outlet port 138 could be through the low point of the cylinder of the container 112 for certain applications.

A bracket 144 includes a pair of spaced apart mounting supports 146 and is affixed to the container 112 on one side of the vertical axis 156 of the container. The ends of the supports 146 spaced from the container 112 have a substantially horizontal edge 148 with an aperture 150 through an end portion of each support in horizontal alignment with each other. A horizontal axis 152 connecting the centers of the two apertures 150 is parallel to the horizontal or longitudinal axis 139 of the container 112. As shown in FIG. 1, a line 154 drawn through the center (at the horizontal or longitudinal axis 139, which could also be referred to as the central axis) of the container 112 and the center (horizontal axis 152) of the apertures 150 of the bracket 144 forms an angle A to the vertical axis 156 of the apparatus. As shown, the angle A between the line 154 and the vertical axis 156 of the container 112 is approximately 45 degrees. The bracket 144 also has a mounting deck 158 between the supports 146 and, as shown, the deck is pivotally mounted to the supports 146 by pivot pins 160 passing through apertures 162 in depending flanges 164 on the deck 158 and through the apertures 150 in the supports 146. The deck 158 is locked in position relative to the supports 146 by means of a pair of bolts 166 passing through arcuate slots 168 in the supports 146. When the bolts 166 are tightened down, the deck 158 is locked in place on the supports 146 on the container 112. For the purposes of FIG. 1, the surface of the deck 158 lies in a plane perpendicular to the vertical axis 156 and parallel to the horizontal axis 152 of the pivot pins 160.

The vibration generator 114 comprises a support plate 169 resiliently mounted on the deck 158 of the bracket 144 by a plurality of springs 170. A motor 172 is mounted on the support plate 169 with the axis of the double ended drive shaft 174 lying substantially parallel to the longitudinal axis 139 of the container 112. Eccentric weights 176 are mounted on each end of the double ended shaft and are encased in covers 178. Variable force vibration generators such as the types shown in my earlier U.S. Pat. Nos. 4,495,826 and 3,358,815 may be substituted for the eccentric weights 176 on each end of the shaft 174. As illustrated in FIGS. 1 through 3, the liner vibratory forces are generated by a two mass system, the motor 172, plate 169 and weights 176 being one mass, and the container 112, bracket 144 and frame 118 being the second mass. The vibration generator 114 as shown in FIG. 1 has an axis 180 which is vertical and intersects the line 154 and the axis 152 of the pivot pins 160 and is perpendicular to the support surface or foundation 128.

Operation of the vibration generator 114 will produce vibratory forces 182 (illustrated generally by the double ended arrow) along a linear path 180. As shown, the linear path 180 and the vibratory forces 182 pass exteriorally of the container 112. The path 180 may intersect the container 112, but it should not go through the center of gravity of the container.

When the apparatus shown in FIGS. 1 and 2 is operating and the vibration generator 114 is producing vibratory forces 182 along the linear path 180, the container 112 will move in an arcuate path, basically segments of a circle, having a center or rotation offset from the center of the container 112 and located at point R. The material within the container 112 in contact with or close to the curved material supporting surface, i.e., the inside surface 183, of the container 112 will be moved along an angle of attack with respect to the inside surface 183 of the container 112. The angle of attack is arcuate, basically a segment of a circle centered at R.

The center of rotation R is either a point or a small closed figure such as a small circle or elipse which for all practical purposes may be considered to be a point. The point R will lie along a line passing through the center of gravity CG of the container 112 and intersecting the vibratory forces 182 along the linear path 180 at an angle of 90 degrees. The intersection is on one side of the center of gravity CG and the point R will be on the other side of the center of gravity.

The center of rotation R should be offset from the center of the cylindrical container 112. If the container 112 is not cylindrical but has a concave material supporting surface such as 183, the center of rotation R should be offset from the centers of circles osculating the concave surface.

In this connection, Webster's New Collegiate Dictonary 1975 defines an osculating circle as "a circle whose center lies on the concave side of a curve on the normal to a given point of the curve and whose radius is equal to the radius of curvature at that point."

Figure 4:
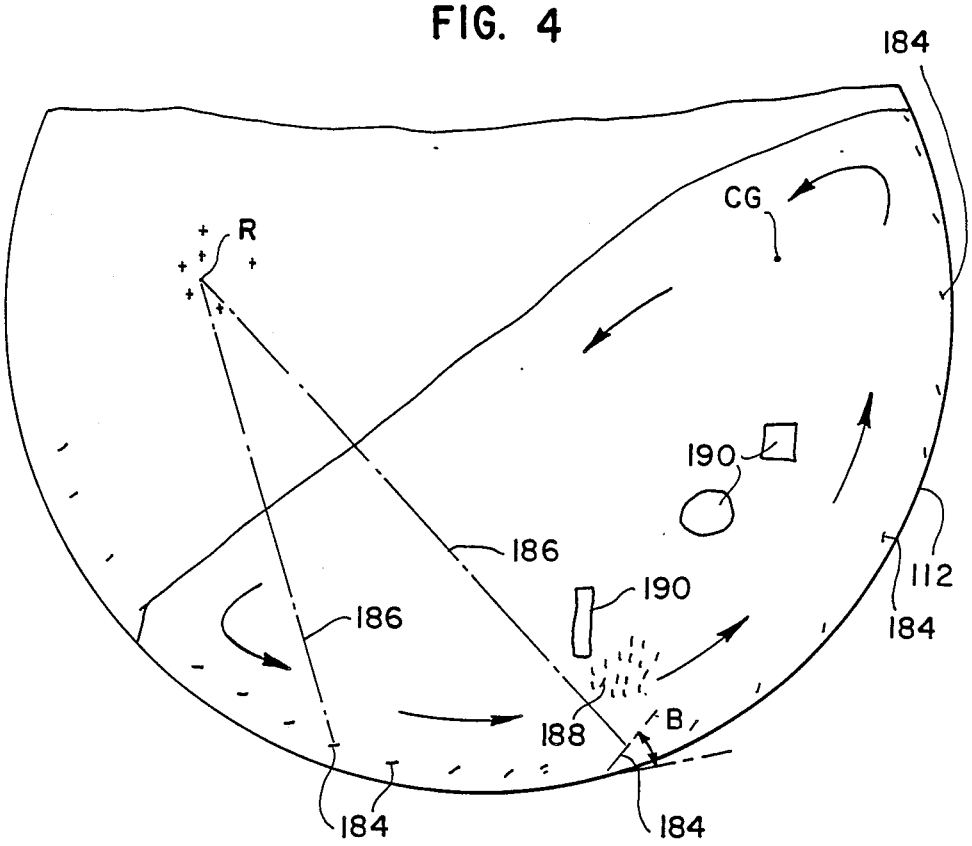
FIG. 4 is a copy of a chart of the paths of movement of material during operation of the apparatus of FIG. 1.

To illustrate the concept (see FIG. 4), a chart of the paths of movement of material during operation of the apparatus is shown. The chart was produced by affixing a sheet of paper to one end of the container 112 after which the vibration generator 114 was energized and tuned to resonance, thereby producing vibratory forces 182 along the linear path 180. A stylus carried by an immovably fixed support on the foundation or stationary surface 128 was engaged with the paper at various points on the end plate 116 in alignment with the surface of the container 112. A tracing of the movement of the container 112 indicated at 184, was subscribed on the paper by the stylus. The stylus was spotted against the paper and container 112 a multiplicity of times in the vicinity of the center of rotation until the point R was located; that is, the point about which the container 112 rotated. By drawing radii 186 from point R to the tracings, it was found that the tracing segments of a circle are centered at R.

The movements 184 along the bottom (or low point) of the container 112 are directed inward into the mass with an angle of attack to produce conveying action of the media and parts. The movement 184 acting on the working media 188 and/or parts 190 in the container 112 provide a vigorous and effective counterclockwise path of motion to the media and parts in the container. The parts and media are conveyed up the inner, i.e., curved or arcuate, material supporting surface 183 of the container 112 adjacent the vibration generator 114 before falling back into the container 112. The vigorous circulatory motion provides improved tumbling of the parts in the media to increase the speed and effectiveness of the mixing in the container 112 and of the burnishing and polishing of the parts.

As shown in FIG. 1, the outlet port 138 can be open or closed. When the outlet port 138 is open, the media and parts will exit the container 112 onto the platform or ramp 140 at the upper portion of the circulatory path. The platform or ramp 140 can be foraminous to permit the media to fall down into a collection receptacle prior to being returned to the container 112 or, as shown, the parts and media can be delivered onto the conveyor 142 to be conveyed to a next processing station.

The character of movement of the container 112 and handling of the material within the container may be altered or modified by moving the location of the center of rotation R. The position of R will change if the direction of the vibratory forces 182 changes. Similarly, the position of R will change if the center of gravity CG is changed such as, for example, by adding weights to the container 112. In this connection, when the center of gravity of the container 112 is referred to herein, it includes not only the container 112 but also parts attached to the container between the springs 130 and the springs 170.

As for the effects of changing the direction of the vibratory forces 182, the teachings of my earlier U.S. Pat. No. 4,709,507 are expressly incorporated herein by reference.

Referring to FIGS. 1, 1*a* and 2, a unique feature of the present invention which represents a substantial improvement over the prior art will be understood and appreciated. It will there be seen that the curved or arcuate material supporting surface 183 has a plurality of generally circumferential, parallel troughs 200 disposed about and extending along the generally horizontal longitudinal axis 139 of the container 112. Preferably, the troughs each have a positive pitch, e.g., on the order of approximately five degress, in a direction toward the material discharge end of the container 112 (see FIG. 2).

As best shown in FIG. 1*a*, the generally circumferential, parallel troughs 200 are suitably formed so as to be generally V-shaped with the exact size and angle of the troughs 200 as well as the exact pitch thereof being determined on a case-by-case basis depending upon the material being handled by the apparatus. In any event, by providing the troughs 200 with a positive pitch, the troughs direct the working media 188 and/or parts 190 upwardly and forwardly to establish a path of tumbling movement in a direction toward the outlet port 138, i.e., from the material input end toward the material discharge end of the container 112.

In other words, the positive pitch of the troughs 200 provides a plurality of trough surfaces inclined relative to the vertical axis 156. This achieves two distinct objectives, i.e., it allows the material such as the working media 188 and/or parts 190 to climb upwardly to a higher position in the container 112 than might otherwise be achieved so as to enhance the tumbling action while at the same time moving the working media 188 and/or parts 190 forwardly for ultimate discharge through the outlet port 138. As will be appreciated, the material will climb in one of the troughs after which it will fall into an axially dowstream trough to then climb once again.

In some cases, it may be desired to have the troughs 200 lying in a plane perpendicular to the generally horizontal longitudinal axis 139. If so, the horizontal axis 139 of the container 112 can angle downwardly a few degrees from the horizontal so that the outlet end of the container 112 is lower than the inlet end. In this manner, flow of the material can again be accomodated through the container 112 as the tumbling, mixing, polishing and/or shake-out is taking place.

Referring to FIG. 1*a*, the troughs 200 can be part of an entirely separate liner defining the curved or arcuate material supporting inner surface 183 within the container 112. Alternatively, the troughs 200 could be formed directly in the relevant portion of the inner surface of the container 112 itself. However, when the curved or arcuate material supporting inner surface 183 is that of a liner, the liner may suitably be formed of a heat resistent material.

In this manner, it is possible to feed working media 188 and/or parts 190 such as hot sand and castings directly into the container 112. Thus, there need be no interruption in time following a casting process but, rather, the cast products as well as the surrounding media can all be further processed in the container 112 without a delay for cooling. In addition, by utilizing a liner, the liner will act as a wear surface and can be replaced when it becomes worn.

A valuable and perhaps surprising characteristics in the operation of the apparatus when used as a vibrating tumbling apparatus where parts and a media are placed within the container is that the parts themselves will remain immersed in the media. This is of importance not only in enhancing the cleaning and burnishing effect of the operation but also in preventing damage to the parts being treated which would occur if the parts surfaced and vibrated directly against the interior surfaces of the container and against each other.

While in the foregoing there has been set forth a preferred embodiment of the invention, it will be understood and appreciated that the invention is only to be limited by the true spirit and scope of the appended claims.

I claim:

1. A vibratory apparatus, comprising:

a container having a curved material supporting surface disposed about a generally horizontal longitudinal axis, said container having a center of gravity offset from said longitudinal axis, said curved material supporting surface having a plurality of generally circumferential, parallel troughs disposed along said longitudinal axis;

said container having a material input end and a material discharge end, said material input end being axially spaced from said material discharge end of said container, said troughs each having a positive pitch in a direction toward said material discharge end to feed the material from the input end to the discharge end;

means for resiliently mounting said container relative to a mounting surface; and vibration generating means mounted on said container for producing vibratory forces directed along a linear path, said linear path being displaced not only from said longitudinal axis but also from said center of gravity of said container.

2. The vibratory apparatus as defined in claim 1 wherein said linear path of vibratory forces passes on the side of said center of gravity remote from said longitudinal axis of said container to cause each point on said curved material supporting surface to rotate along a path lying on a segment of a circle.

3. The vibratory apparatus as defined in claim 2 wherein each of said segments of said circles has a center of rotation located at a position displaced from said longitudinal axis and on the side thereof remote from said center of gravity of said container so that segments of said circles do not conform to said curved material supporting surface.

4. The vibratory apparatus as defined in claim 2 wherein each of said segments of said circles has a center of rotation on the other side of said longitudinal axis from said center of gravity of said container and lying on a line extending normal to said linear path and passing through said center of gravity of said container.

5. The vibratory apparatus as defined in claim 1 wherein said resilient mounting means mounts said container for unconstrained vibratory movement.

6. The vibratory apparatus as defined in claim 1 wherein said positive pitch of said troughs is on the order of approximately five degrees.

7. The vibratory apparatus as defined in claim 1 wherein said generally circumferential, parallel troughs are generally V - shaped.

8. The vibratory apparatus as defined in claim 1 wherein said curved material supporting surface comprises a liner formed of heat resistant material.

9. A vibratory apparatus, comprising:

a generally horizontally arranged cylindrical container having an arcuate material supporting surface disposed about a longitudinal axis, said container having a center of gravity offset from said longitudinal axis, said arcuate material supporting surface having a plurality of generally circumferential, parallel troughs disposed along said longitudinal axis;

means for resiliently mounting said container relative to a mounting surface for unconstrained vibrating movement;

said container having a material input end and a material discharge end, said material input end being axially spaced from said material discharge end of said container, said troughs each having a positive pitch in a direction toward said material discharge end to feed the material from the input end to the discharge end; and vibration generating means mounted on said container for producing vibratory forces directed along a linear path, said linear path being displaced not only from said longitudinal axis but also from said center of gravity of said container;

said linear path of vibratory forces passing on the side of said center of gravity remote from said longitudinal axis of said container to cause each point on said arcuate material supporting surface to rotate along a path lying on a segment of a circle, each of said segments of said circles having a center located at a position displaced from said longitudinal axis and on the side thereof remote from said center of gravity so said segments of said circles do not conform to said arcuate material supporting surface.

10. The vibratory apparatus as defined in claim 9 wherein said positive pitch of said troughs is on the order of approximately five degrees.

11. The vibratory apparatus as defined in claim 9 wherein said generally circumferential, parallel troughs are generally V - shaped.

12. The vibratory apparatus as defined in claim 9 wherein said arcuate material supporting surface comprises a liner formed of heat resistant material.

13. A vibratory apparatus, comprising:

a frame and resilient means mounting said frame on a mounting surface;

a container having a curved surface disposed about a generally horizontal longitudinal axis supported by said frame and together with said frame having a center of gravity offset from said longitudinal axis of said container;

vibration generating means for producing vibrational forces displaced not only from said longitudinal axis but also from said center of gravity of said container; and a liner defining a curved material supporting inner surface within said container, said liner having a plurality of generally circumferential, parallel troughs facing inwardly of said container, said troughs being disposed along said longitudinal axis of said container;

said container having a material input end and a material discharge end, said material input end being axially spaced from said material discharge end of said container, said troughs each having a positive pitch in a direction toward said material discharge end to feed the material from the input end to the discharge end;

said vibrational forces being displaced to the side of said center of gravity away from said longitudinal axis of said container, said vibrational forces producing a center of rotation on the other side of said longitudinal axis of said container from said center of gravity to produce rotational forces acting substantially perpendicular to radii drawn from said center of rotation to a point on said curved material supporting inner surface of said container, said vibrational forces causing media and parts being tumbled in said container to be moved up said troughs of said liner;

whereby said troughs direct said media and parts upwardly and forwardly to establish a path of tumbling movement for said media and parts in a direction from said material input end toward said material discharge end of said container.

14. The vibratory apparatus as defined in claim 13 wherein said vibration generating means is mounted on said container so as to cause said vibrating forces to be directed along a linear path, said linear path being displaced not only from said longitudinal axis but also from said center of gravity of said container.

15. The vibratory apparatus as defined in claim 14 wherein said linear path of said vibrating forces passes on the side of said center of gravity away from said longitudinal axis of said container to cause each point on said curved material supporting inner surface to rotate along a path lying on a segment of a circle.

16. The vibratory apparatus as defined in claim 15 wherein each of said segments of said circles has a center coincident with said center of rotation at a position located relative to said container such that said segments of said circles do not conform to said curved material supporting inner surface of said container.

17. The vibratory apparatus as defined in claim 13 wherein said positive pitch of said troughs is on the order of approximately five degrees.

18. The vibratory apparatus as defined in claim 13 wherein said generally circumferential, parallel troughs are generally V - shaped.

19. The vibratory apparatus as defined in claim 13 wherein said liner is formed of heat resistant material.

* * * * *